US010082753B2

(12) United States Patent
Goto et al.

(10) Patent No.: US 10,082,753 B2
(45) Date of Patent: Sep. 25, 2018

(54) FIXING MEMBER HAVING RELEASING LAYER ON THE SURFACE

(71) Applicant: SYNZTEC CO., LTD., Tokyo (JP)

(72) Inventors: Masayuki Goto, Kanagawa (JP); Wataru Nemoto, Kanagawa (JP); Tadashi Hasegawa, Kanagawa (JP); Masaya Suzuki, Kanagawa (JP)

(73) Assignee: SYNZTEC CO., LTD., Tokyo (JP)

( * ) Notice: Subject to any disclaimer, the term of this patent is extended or adjusted under 35 U.S.C. 154(b) by 0 days.

(21) Appl. No.: 15/354,163

(22) Filed: Nov. 17, 2016

(65) Prior Publication Data

US 2017/0139359 A1 May 18, 2017

(30) Foreign Application Priority Data

Nov. 18, 2015 (JP) ..... 2015-226043

(51) Int. Cl.
*G03G 15/20* (2006.01)

(52) U.S. Cl.
CPC ..... *G03G 15/2057* (2013.01)

(58) Field of Classification Search
CPC ..... G03G 15/206; G03G 15/2057
USPC ..... 399/333
See application file for complete search history.

(56) References Cited

U.S. PATENT DOCUMENTS

2011/0003118 A1* 1/2011 Ohtsu ..... C08G 73/1039 428/141

FOREIGN PATENT DOCUMENTS

| | | | |
|---|---|---|---|
| JP | 06250551 A | * | 9/1994 |
| JP | 09-237007 | | 9/1997 |
| JP | 4790002 | | 10/2011 |
| JP | 2014-112201 | | 6/2014 |

* cited by examiner

*Primary Examiner* — Billy Lactaoen
(74) *Attorney, Agent, or Firm* — Young & Thompson

(57) ABSTRACT

The invention provides a fixation member having a fluororesin tube serving as a release layer which attains both suitable electrical conductivity and high releasability. The fixation member (fixation tube) has a release layer on the surface thereof. The release layer is formed of a fluororesin tube containing carbon. The fluororesin tube has a percent dielectric relaxation of 1.0% to 5.0% or an optical transmission density of 1 to 4. The fluororesin tube preferably has a dielectric constant of 2.15 to 2.5.

3 Claims, 5 Drawing Sheets

FIXING MEMBER HAVING RELEASING LAYER ON THE SURFACE

The entire disclosure of Japanese Patent Application No. 2015-226043 filed on Nov. 18, 2015 is expressly incorporated by reference herein.

BACKGROUND OF THE INVENTION

Field of the Invention

The present invention relates to an image-fixing member (hereinafter referred to as a "fixation member") which is particularly employed in a fixation unit of an image-forming apparatus such as an electrophotographic printer or copying machine.

Background Art

Generally, an image-fixation unit of an image-forming apparatus such as an electrophotographic printer or copying machine employs a fixation belt formed of an electrocast layer (nickel (Ni), Ni/copper (Cu)/Ni, PI (polyimide resin), SUS (stainless steel), etc.), an elastic layer, a release layer (fluororesin tube), etc.; a fixation roller or a pressure roller formed of a metallic core, an elastic layer, a release layer, etc.; or the like.

In a typical fixation apparatus 100 shown in FIG. 1, a fixation belt 104 (a fixation member in the form of a belt) moves with a pressure roller 101 in rotation, and a fixation roller (an inner roller 105) which is heated by means of heating means 103 disposed in a space 102 rotates with the pressure roller 101, whereby an unfixed toner image 107 on a recording medium 106 (e.g., a paper sheet) is fixed through heat and pressure during passage of the recording medium between the fixation belt 104 and the pressure roller 101. In the fixation apparatus 100, the fixation belt 104 is disposed so as to face oppositely the toner-provided surface of the recording medium 106. Thus, the fixation belt 104 comes into direct contact with the unfixed toner image 107.

In the above fixation apparatus 100, the heating means 103 is disposed in the space defined by the fixation belt 104 by the mediation of a heating roller 108. Other than this configuration of the fixation apparatus, there exist, for example, a fixation apparatus in which heating means is disposed so as to face oppositely the outside of the fixation belt, and a fixation apparatus having a roller-shape fixation member. Also, a variety of heating means are employed in such fixation members. Examples thereof include a halogen lamp; resistance heaters such as a metallic resistor, a ceramic heater, and a carbon heater; an electromagnetic induction heater (IH); and a microwave heater.

Meanwhile, a problem of toner off set is involved in conventional fixation apparatuses. "Toner offset" refers to toner remaining on a fixation member during passage of a recording paper sheet and includes offset caused by an electrical reason (e.g., electrostatic offset) and offset caused by a thermal reason (e.g., hot offset or cold offset). Thus, toner image fixation must be carried out under such conditions that occurrence of toner offset is prevented.

In a recent trend for obtaining a toner image of higher quality, the surface of a fixation member which comes into direct contact with toner is required to have high releasability with respect to toner or paper dust (hereinafter may be refereed to simply as "releasability"). Thus, the amount of such dust must be reduced by lowering the surface energy. In order to reduce the surface energy of a fixation member, there have been proposed fixation members which employ, at least on a surface thereof, a fluororesin such as PFA (perfluoroalkoxyfluororesin) or PTFE (polytetrafluoroethylene) (see, for example, Patent Documents 1 and 2).

Notably, the polarity of a toner employed in an image-forming apparatus varies depending on the type of the apparatus. When a positively charged toner is used, electrostatic offset must be prevented. In one disclosed technique, graphite powder is charged into a heat-resistant offset-preventing coating layer formed of fluororesin which has been disposed on the surface of a heat/fixation roller serving as a fixation member, whereby electrostatic offset of the fixation member is prevented (see, for example, Patent Document 3).

Patent Document 1: Japanese Patent Application Laid-Open (kokai) No. 2014-112201

Patent Document 2: Japanese Patent No. 4790002

Patent Document 3: Japanese Patent Application Laid-Open (kokai) No. 1997-237007

According to Patent Document 3, graphite is added to a fluororesin tube forming the release layer of a fixation member, to thereby provide the release layer with electrical conductivity, whereby electrostatic offset of the fixation member can be prevented. However, when the fluororesin tube has electrical conductivity, the surface energy of the tube increases, and releasability decreases, which is problematic. Thus, in provision of a fixation member, there is demand for a fluororesin tube having suitable electrical conductivity and high releasability.

SUMMARY OF THE INVENTION

The present invention has been conceived in order to solve the aforementioned technical problems. Thus, an object of the present invention is to provide a fixation member having a fluororesin tube serving as a release layer which attains both suitable electrical conductivity and high releasability.

In one mode of the present invention for attaining the object, there is provided a fixation member having a release layer on a surface thereof, wherein the release layer is formed of a fluororesin tube including carbon, and the fluororesin tube has a percent dielectric relaxation of 1.0% to 5.0%.

In another mode of the present invention, there is provided a fixation member having a release layer on a surface thereof, wherein the release layer is formed of a fluororesin tube including carbon, and the fluororesin tube has an optical transmission density of 1 to 4.

In the above fixation members, the fluororesin tube preferably has a dielectric constant of 2.15 to 2.5.

The present invention can provide a fixation member having a fluororesin tube serving as a release layer which attains both suitable electrical conductivity and high releasability.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

Specific embodiment of the present invention will be described next in detail. Such embodiments are given for the purpose of illustration, and the present invention may be arbitrarily modified, so long as the modification falls within the scope of the present invention.

Embodiment 1

1. Fixation Belt and Production Method Therefor

The fixation member according to the present invention is suitably employed in a fixation apparatus of an image-forming apparatus such as an electrophotographic printer or copying machine, so as to be adapted to fix an unfixed toner image onto a recording medium (e.g., a paper sheet) through heat and pressure in the fixation apparatus. In Embodiment 1, an endless fixation belt (endless belt or endless film) is exemplified as a fixation member.

Figure 1:
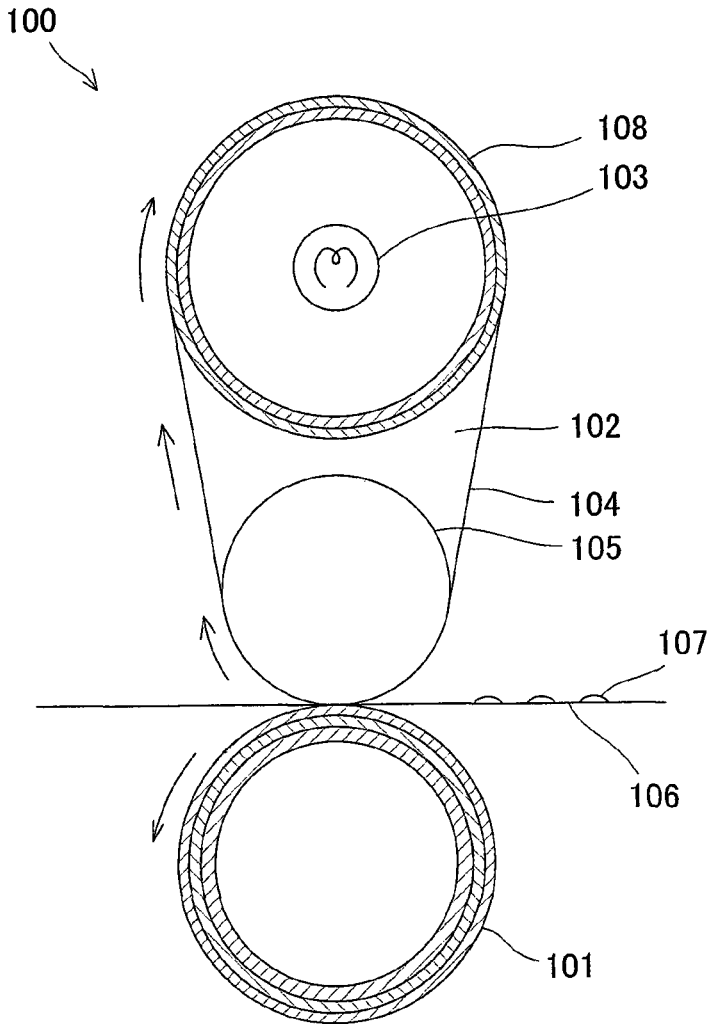
FIG. 1 is a schematic cross-section of the structure of a typical fixation apparatus.
Figure 2:
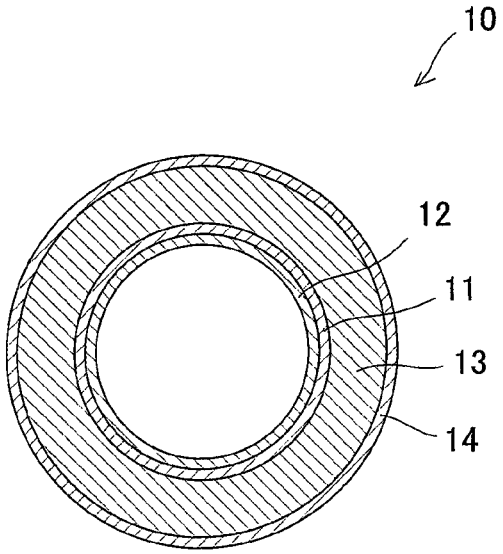
FIG. 2 is a schematic cross-section of the structure of a fixation member according to Embodiment 1.

FIG. 2 is a schematic cross-section of a fixation belt 10. The fixation belt 10 serving as a fixation member includes a substrate 11, a sliding layer 12 formed on the internal surface of the substrate 11, an elastic layer 13 formed on the external surface of the substrate 11, and a release layer 14 formed on the external surface of the elastic layer 13. The sliding layer 12, the substrate 11, the elastic layer 13, and the release layer 14 are sequentially stacked from the core.

The substrate 11 has at least one layer selected from among metallic layers formed of a metallic material having excellent thermal conductivity and mechanical strength (e.g., SUS alloy, nickel (Ni), nickel alloy, iron (Fe), magnetic stainless steel, or cobalt-nickel (Co—Ni) alloy) and resin layers formed of a resin such as PI (polyimide resin). In Embodiment 1, an electrocast nickel monolayer seamless belt is employed as the substrate 11. The electerocast seamless belt is formed of nickel or an electrocast nickel alloy containing one or more elements selected from among phosphorus (P), iron, cobalt, and manganese (Mn). Notably, the substrate 11 may be an electrocast multi-layer seamless belt (e.g., a trilayer structure of nickel/copper/nickel (Ni/Cu/Ni)).

The total thickness of the substrate 11 is, for example, 1 μm to 300 μm, preferably 20 μm to 100 μm, more preferably 25 μm to 60 μm. When the thickness of the substrate 11 is smaller than 1 μm, the substrate fails to have sufficient mechanical strength. In addition, the toughness of the substrate decreases, thereby failing to attain sufficient durability against printing of a large number of paper sheets. When the thickness of the substrate 11 is greater than 300 μm, the toughness increases excessively, and bending stress increases. As a result, durability decreases. In Embodiment 1, an electrocast nickel seamless belt (φ40) having a thickness of 40 μm is employed as the substrate 11.

The sliding layer 12 is suitably formed of a resin which is excellent in durability, heat resistance, and wear resistance. Examples of such resin include polyimide resin (PI) and polyamide-imide resin (PAI). The resin may further include an optional fluororesin.

Examples of the fluororesin which may be added to the sliding layer include perfluoroalkoxyfluororesin (PFA), polytetrafluoroethylene (PTFE), tetrafluoroethylene-ethylene copolymer (ETFE), tetrafluoroethylene-hexafluoropropylene copolymer (FEP), poly(vinylidene fluoride) (PVDF), and chlorotrifluoroethylene-ethylene copolymer (ECTFE). Among them, polytetrafluoroethylene (PTFE) is particularly preferred.

Embodiment 1 employs the sliding layer 12. However, the fixation belt may have no sliding layer 12.

On the external surface of the substrate 11, the elastic layer 13 is provided by the mediation of an adhesive layer (not illustrated). The elastic layer 13 may be formed of a known elastic material such as silicone rubber, fluororubber, or urethane rubber.

The thickness of the elastic layer 13 is preferably 100 μm or greater, in order to prevent unevenness in gloss, which would otherwise occur in the case where the heated surface of the fixation belt 10 cannot follow irregularities of a recording medium 26 (e.g., a paper sheet) (see FIG. 3) or of a toner layer (not illustrated), during printing of images.

When the thickness of the elastic layer 13 is smaller than 100 μm, difficulty is encountered in attaining the function of the elastic layer 13 as an elastic member. In this case, uniform pressure distribution fails to be attained during fixation of the unfixed toner image 27 (see FIG. 3). As a result, particularly when a full-color image is fixed, the secondary color unfixed toner image 27 cannot be thermally fixed to a satisfactory extent, whereby unevenness is provided in gloss of the fixed images. Color mixing becomes poor due to insufficient melting conditions of the unfixed toner 27, thereby failing to obtain ultrafine full-color image, which is not preferred.

In Embodiment 1, the elastic layer 13 is formed of silicone rubber and has a thickness of 270 μm. In Embodiment 1, the elastic layer 13 is formed through a coating process according to the ring coating method disclosed in Patent Document 1. However, no particular limitation is imposed on the coating process, and the process may be appropriately modified as necessary.

In Embodiment 1, through provision of the aforementioned elastic layer 13, the flexibility of the fixation belt 10 and the heat efficiency of the fixation apparatus 1 employing the fixation belt (see FIG. 3) can be enhanced, whereby fixability of the unfixed toner image 27 onto the recording medium 26 can be enhanced. As a result, an image of higher quality can be obtained. Notably, provision of the elastic layer 13 is optional, and no elastic layer may be provided.

From the viewpoints of moldability and toner releasability, the release layer 14 is suitably a fluororesin tube formed through extrusion. The fluororesin forming the fluororesin tube is suitably tetrafluoroethylene/perfluoroalkyl vinyl ether copolymer (PFA resin), which has excellent heat resistance. In other words, a fluororesin tube (PFA tube) formed of a PFA resin through extrusion is suitably used.

No particular limitation is imposed on the copolymerization mode of the PFA resin serving as a raw material, and any of random copolymerization, block copolymerization, and graft copolymerization may be accepted. Also, no particular limitation is imposed on the mole ratio of tetrafluoroethylene (TFE) to perfluoroalkyl vinyl ether (PAVE) of the PFA resin serving as a raw material, and a TFE/PAVE mole ratio of, for example, 94/6 to 99/1 is preferably employed.

Other than PFA resin, examples of the fluororesin forming the fluororesin tube include tetrafluoroethylene/hexafluoropropylene copolymer (FEP), polytetrafluoroethylene (PTFE), and ethylene/tetrafluoroethylene copolymer (ETFE), as well as polychlorotrifluoroethylene (PCTFE), ethylene/chlorotrifluoroethylene copolymer (ECTFE), poly (vinylidene fluoride) (PVDF). These fluororesins may be used singly or in combination of two or more species.

In Embodiment 1, in order to attain electrical conductivity and high toner releasability of the fluororesin tube forming the release layer 14, the fluororesin tube is produced through extrusion of a mixture of an insulating fluororesin with a small amount of carbon (C). The thus-produced fluororesin tube has slightly increased electrical conductivity (hereinafter such a tube is referred to as a "slightly conducting tube").

No particular limitation is imposed on the form of carbon added to the fluororesin, so long as the carbon species can impart slight electrical conductivity to the fluororesin forming the fluororesin tube. Examples of the carbon species include carbon powder, carbon fiber, carbon thread, carbon needle, and carbon rod. Specific examples include carbon black, carbon fiber, carbon atom cluster, and a mixture thereof. Examples of the carbon fiber include acrylic carbon fiber (PAN), pitch-based carbon fiber (PITCH), carbon fiber-reinforced plastics (FRP), and a mixture thereof. Examples of the carbon atom cluster include carbon nanotubes and a mixture thereof.

In Embodiment 1, the obtained slight conductivity of the slightly conducting tube is assessed with its dielectric constant as an index. That is, the distance between carbon particles (or similar objects) added to the fluororesin tube is assessed. The dielectric constant of the slightly conducting tube is preferably adjusted to 2.15 to 2.5, more preferably 2.2 to 2.4. When the dielectric constant of the slightly conducting tube is lower than 2.15, the distance between carbon particles (or similar objects) increases, thereby failing to attain slightly increased conductivity of the fluororesin tube and failing to prevent electrostatic offset on the fixation belt 10. When the dielectric constant of the slightly conducting tube is in excess of 2.5, the distance between carbon particles (or similar objects) decreases, thereby increasing the surface energy of the fluororesin tube, and as a result, impairing releasability of the fixation belt 10. Needless to say, both cases are not preferred. So long as the carbon species is added to the fluororesin so that the dielectric constant falls within the aforementioned range, the amount of carbon species may be appropriately modified in accordance with the mode, type, etc., of the carbon added.

Meanwhile, the amount of added carbon may be evaluated on the basis of optical transmission density defined by the following formulas (1) and (2):

$$\text{optical transmittance}=\text{transmitted light}/\text{incident light} \quad (1); \text{ and}$$

$$\text{optical transmission density}=\log_{10}(1/\text{optical transmittance}) \quad (2).$$

Specifically, in Embodiment 1, when the slightly conducting tube has an optical transmission density of 1 to 4 and an appropriate optical transmittance, both electrical conductivity and high releasability of the slightly conducting tube can be attained.

When the dielectric constant falls within the aforementioned range, the slightly conducting tube has preferred electrical properties. More specifically, in Embodiment 1, the slightly conducting tube has a surface resistivity of $10^{10}$ Ω/square or higher, which corresponds to such an electrical conductivity that charging of the slightly conducting tube can be prevented to a certain extent. In addition, scattering (offset) of toner on the slightly conducting tube by virtue of a percent dielectric relaxation of 1.0% to 5.0%. Meanwhile, the percent dielectric relaxation is a percent drop in surface voltage for 10 seconds immediately after charging at 4 kV and thus is defined by the following formula (3):

$$\text{percent dielectric relaxation}=(\text{drop in surface voltage for 10 seconds}/\text{initial charge})\times 100 \quad (3).$$

In other words, the "drop in surface voltage for 10 seconds" in formula (3) is calculated by "initial charge–charge after 10 seconds."

The slightly conducting tube employed in Embodiment 1 is a PFA tube produced through extrusion of a mixture of an insulating fluororesin with carbon. The thickness of the tube is 30 μm. The inner diameter of the tube is 38 mm, which is smaller than the outer diameter of the elastic layer 13. In order to enhance adhesion, the internal surface of the tube is subjected to ammonia treatment.

In Embodiment 1, the thus-produced slightly conducting tube is subjected to polishing, to thereby adjust the arithmetic average roughness (Ra) to 0.02 μm to 0.06 μm (JIS 94). As a result, fixability of the unfixed toner image 27 onto the recording medium 26 can be enhanced when the fixation apparatus 1 employing the fixation belt 10 (see FIG. 3) is employed. As a result, the image quality can be enhanced.

In Embodiment 1, the slightly conducting tube which forms the release layer 14 serving as a surface layer of the fixation belt 10 is provided by attaching the slightly conducting tube to the substrate and stretching the tube, to thereby complete coating. In other words, the slightly conducting tube is attached to the elastic layer 13 coated with an adhesive layer (not illustrated) and then stretched (see, for example, Patent Documents 1 and 2).

More specifically, the slightly conducting tube (thickness: 30 μm) is attached to the external surface of the substrate 11 coated with the elastic layer 13 (i.e., to the external surface of the elastic layer 13) by the mediation of an adhesive layer (not illustrated) and then stretched. Subsequently, the entire body is heated by heating means (not illustrated) such as an electric furnace, to thereby cure the adhesive layer. As a result, the slightly conducting tube is firmly fixed to the entire surface of the elastic layer 13. After heating, the entire body including the slightly conducting tube is allowed to cool, and both ends of the substrate 11 are cut by means of a cutting mechanism, to thereby adjust the length of the fixation belt 10. Then, the cut surfaces are polished by means of a polishing mechanism. Through such a series of production steps, the fixation belt 10 is produced.

In Embodiment 1, the percent stretch of the slightly conducting tube in the longitudinal direction, with respect to the entire length (length in a non-stretched state) of the slightly conducting tube attached to the elastic layer 13 of the substrate 11 before stretching, is 7%. Through stretching the slightly conducting tube along the longitudinal direction, the slightly conducting tube can be free from wrinkle, to thereby provide the high-durability fixation belt 10.

Although not illustrated, the release layer 14 is formed on the external surface of the elastic layer 13 by the mediation of an adhesive layer. The adhesive layer is uniformly provided via coating on the surface of the elastic layer 13 at a specific thickness. In Embodiment 1, the adhesive layer is formed of a cured product of a silicone rubber-based adhesive of an addition curing type. The silicone rubber-based adhesive of an addition curing type includes one containing a self-adhesion component.

More specifically, the silicone rubber-based adhesive of an addition curing type contains an organopolysiloxane having an unsaturated hydrocarbon group (e.g., vinyl group), a hydrogenorganopolysiloxane, and a platinum compound serving as a cross-linking catalyst. The adhesive is then cured via addition reaction. A known adhesive of this type may be used. In Embodiment 1, the adhesive layer is provided so as to uniformly adjust the thickness to about 30 μm.

2. Fixation Apparatus

An embodiment of the fixation apparatus will be described next. The fixation apparatus according to the present invention is employed in an image-forming apparatus so as to be adapted to fix an unfixed toner image onto a recording medium through heat and pressure.

Figure 3:
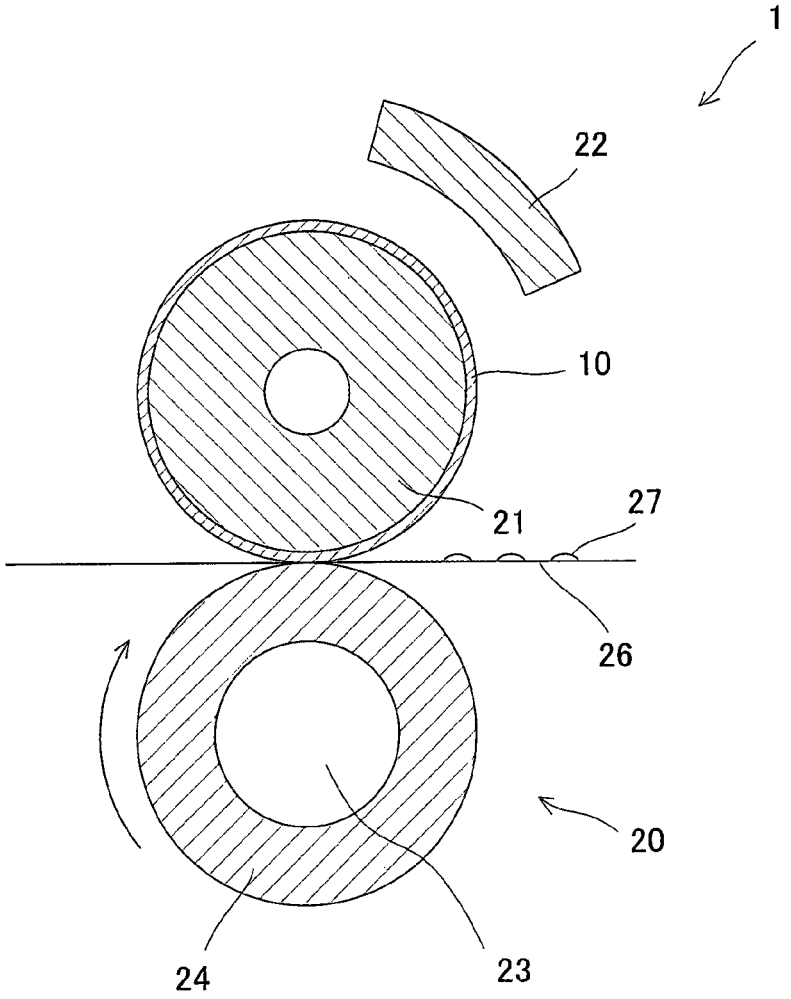
FIG. 3 is a schematic cross-section of the structure of the fixation apparatus according to Embodiment 1.

FIG. 3 is a schematic cross-section of a fixation apparatus 1 employing the fixation belt 10 shown in FIG. 2. As shown in FIG. 3, the fixation apparatus 1 includes the fixation belt 10 (fixation member), a pressure roller 20 disposed so as to face oppositely the fixation belt 10, an inner roller 21 adapted to press the pressure roller 20 via the fixation belt 10, and an IH coil 22 (heating means) for heating the fixation belt 10 to a target temperature through IH (electromagnetic induction heating). The inner roller 21 is disposed in the space defined by the fixation belt 10 and rotates the inner roller 21 and the fixation belt 10 through rotation of the pressure roller 20. In Embodiment 1, a portion of the fixation belt 10 which generates heat corresponds to an electrocast nickel part which forms the substrate 11.

The pressure roller 20 has a core 23 formed of a material such as a metal, and an elastic layer 24 formed on the core 23, the elastic layer being formed of a material such as a rubber. The core 23 is preferably hollow from the viewpoint of reduction in heat capacity, but is not necessarily hollow. The elastic layer 24 may further have, on the surface thereof, an optional tube or coating layer formed of a fluororesin such as PEA, a silicon rubber, or the like. In Embodiment a silicon rubber layer (thickness: 4 mm) is used as the elastic layer 24, and the surface of the elastic layer 24 is coated with a PFA tube having a thickness of 50 μm (not illustrated).

The fixation apparatus 1 includes the aforementioned IH coil 22. In Embodiment 1, the IH coil 22 is employed as heating means for the fixation belt 10. However, the heating means is not particularly limited to the IH coil 22, so long as it can heat the fixation belt 10. The heating means may be disposed outside the fixation belt or inside the pressure roller. Examples of the heat source include a halogen heater, an ohmic heater, an IR heater, a carbon heater, and a microwave heater.

The fixation apparatus 1 has the fixation belt 10 which can attain both electrical conductivity and high releasability of the slightly conducting tube forming the aforementioned release layer 14. According to the fixation apparatus, the amount of toner and paper dust on the surface of the slightly conducting tube can be reduced, to thereby reduce occurrence of toner offset, even when a positively charged toner is used.

Embodiment 2

1. Fixation Roller and Production Method Therefor

Figure 4:
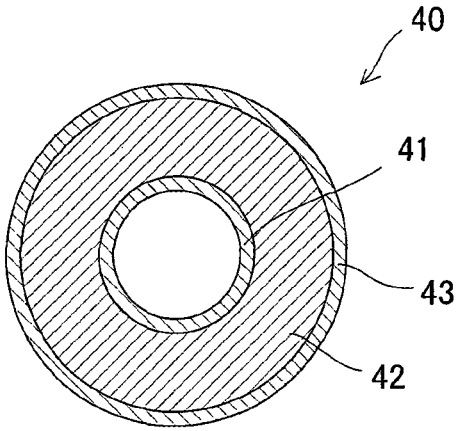
FIG. 4 is a schematic transverse cross-section of the structure of a fixation member according to Embodiment 2.
Figure 5:
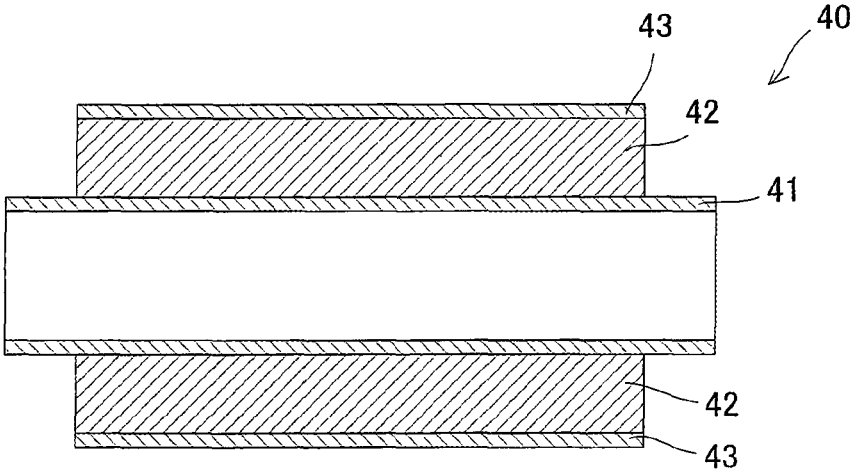
FIG. 5 is a schematic longitudinal cross-section of the structure of the fixation member according to Embodiment 2.

In Embodiment 2, a fixation roller is exemplified as a fixation member. FIG. 4 is a transverse sectional view of a fixation roller 40, and FIG. 5 is a longitudinal sectional view of the fixation roller 40. As shown in FIGS. 4 and 5, the fixation roller 40 includes a core 41, an elastic layer 42 disposed on the core 41, and a release layer 43 disposed on the elastic layer 42.

The core 41 forming the fixation roller 40 (fixation member) is formed of a metallic or resin material having excellent thermal conductivity and mechanical strength. No particular limitation is imposed on the metallic or resin material, so long as the material can be used as the core of the fixation roller 40. For example, the material of the substrate 11 of the fixation belt 10 in Embodiment 1 may be used. No particular limitation is imposed on the shape of the core 41, and the core may be hollow or non-hollow. In Embodiment 2, a pipe-shape core is used as the core 41.

On the surface of the core 41, the elastic layer 42 is disposed by the mediation of an adhesive layer (not illustrated). No particular limitation is imposed on the material of the elastic layer 42, so long as the material has high thermal conductivity. For example, the material of the elastic layer 13 of the fixation belt 10 may also be used. No particular limitation is imposed on the method of forming the elastic layer 42, and a method disclosed in Japanese Patent Application Laid-Open (kokai) No. 2015-031755 may be employed. In Embodiment 2, the elastic layer 42 is formed through the method disclosed in the Patent Document. The thickness of the elastic layer 42 is preferably 2 mm or less, in order to maintain high thermal conductivity. Notably, the elastic layer 42 may be provided as necessary, and is not necessarily provided.

From the viewpoints of moldability and toner releasability, the release layer 43 is preferably formed of the same material as the slightly conducting tube forming the release layer 14 of the fixation belt 10. In Embodiment 2, from the viewpoints of attaining both electrical conductivity and high releasability of the slightly conducting tube forming the release layer 43, a slightly conducting tube having slight electrical conductivity realized through addition of a small amount of carbon (C) thereto is employed as the release layer 43.

No particular limitation is imposed on the thickness of the release layer 43, so long as the release layer 43 can impart high releasability to the fixation roller 40. The thickness is 10 μm to 100 μm, preferably 20 μm to 50 μm.

In the case where the release layer 43 is formed on the elastic layer 42, a slightly conducting tube is used, similar to the case of the release layer 14 of the fixation belt 10. Alternatively, the elastic layer 42 and the release layer 43 may be individually molded in separate steps. Needless to say, in both cases, the fixation roller 40 which has low roller hardness, small variation in hardness along the axial direction, and high thermal conductivity can be produced.

2. Fixation Apparatus

Figure 6:
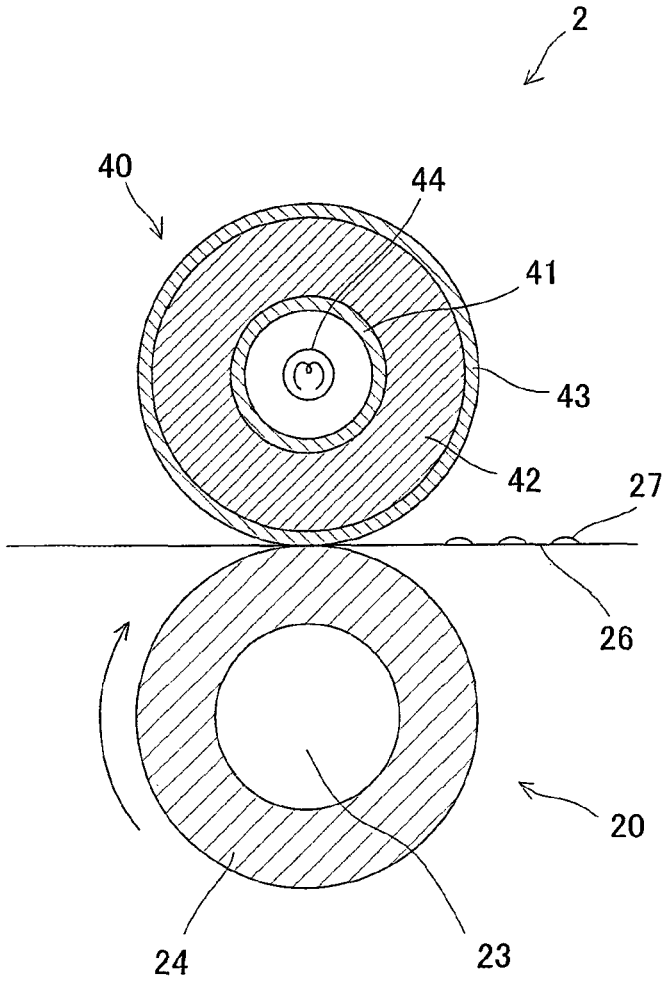
FIG. 6 is a schematic cross-section of the structure of the fixation apparatus according to Embodiment 2.

An embodiment of the fixation apparatus will be described next. FIG. 6 is a schematic cross-section of a fixation apparatus 2 employing the fixation roller 40 shown in FIGS. 4 and 5. As shown in FIG. 6, the fixation apparatus 2 has the same structure as that of the fixation apparatus 1, except that the fixation belt 10 of the fixation apparatus 1, the inner roller 21, and the IH coil 22 (Embodiment 1) are changed to the fixation roller 40 (fixation member) and a halogen heater 44 (heating means). Thus, the same members as employed in the fixation apparatus 1 of Embodiment 1 are denoted by the same reference numerals, and overlapping descriptions will be appropriately omitted.

As shown in FIG. 6, the fixation apparatus 2 includes a pressure roller 20 and the fixation roller 40 which is disposed so as to face oppositely the pressure roller 20. The fixation roller 40 includes a halogen heater 44 therein. Notably, the fixation roller 40 of Embodiment 2 may also serve as the fixation roller 40 and the pressure roller 20 shown in FIG. 6. In Embodiment 2, the halogen heater 44 is employed as heating means, but other heat sources may also be employed. Examples thereof include an ohmic heater, an IR heater, a carbon heater, an IH coil, and a microwave heater.

Variations of Fixation Member

Embodiments of the present invention are described hereinabove. However, the essential structure of the present invention is not limited to the aforementioned embodiments.

The fixation member according to the present invention is suitably employed as the aforementioned fixation belt or fixation roller, but may also be employed as a transfer/fixation belt, which is employed in image fixation immediately after image transfer. Thus, no particular limitation is imposed on the mode of use of the fixation belt. The fixation apparatus employing the fixation member of the present invention may be employed in various image-forming apparatuses (particularly, those of electrophotographic-type), such as a copying machine, a facsimile, a laser beam printer, other printers, and multifunction machines thereof.

EXAMPLES

The present invention will be described next in detail by way of examples, which should not be construed as limiting the invention thereto.

Example 1

The fixation belt 10 shown in FIG. 2 was tested in the following manner. The carbon-containing PFA tube (hereinafter referred to simply as a "PFA tube") forming the release layer 14 had a dielectric constant of 2.18 and an optical transmission density of 3.35. Table 1 shows the results. The fixation belt 10 was produced through the following procedure.

An electrocast nickel seamless belt (φ40) having a thickness of 40 μm (substrate 11) was coated with a silane coupling agent through spraying. The thus-coated belt was rotated and dried at 150° C. for 1 minute by means of a shaft heater. Subsequently, silicone rubber (DY35-1114, product of Toray) was diluted with a solvent, and the product was applied onto the belt. The belt was rotated, and the silicone rubber was leveled at 70° C. for 5 minutes by means of a shaft heater. The silicone rubber was primarily cured at 150° C. for 1.5 minutes and 200° C. for 3 minutes, to thereby form the elastic layer 13 formed of a silicone rubber and having a thickness of 270 μm. Subsequently, the external surface of the elastic layer 13 was coated with a PFA tube (release layer 14) by the mediation of a silicone rubber adhesive at a thickness of 30 μm, to thereby form the fixation belt 10.

Example 2

The procedure of Example 1 was repeated, except that the fixation belt 10 shown in FIG. 2 was tested, wherein the PFA tube forming the release layer 14 had a dielectric constant of 2.27 and an optical transmission density of 3.8.

Comparative Example 1

The procedure of Example 1 was repeated, except that the fixation belt 10 shown in FIG. 2 was tested, wherein the PFA tube forming the release layer 14 had a dielectric constant of 2.10 and an optical transmission density of 0.058.

Comparative Example 2

The procedure of Example 1 was repeated, except that the fixation belt 10 shown in FIG. 2 was tested, wherein the PFA tube forming the release layer 14 had a dielectric constant of 2.58 and no optical transmission property.

Comparative Example 3

The procedure of Example 1 was repeated, except that the fixation belt 10 shown in FIG. 2 was tested, wherein the PFA tube forming the release layer 14 had a dielectric constant of 2.87 and no optical transmission property.

Comparative Example 4

The procedure of Example 1 was repeated, except that the fixation belt 10 shown in FIG. 2 was tested, wherein the PFA tube forming the release layer 14 had a dielectric constant of 3.43 and no optical transmission property.

Comparative Example 5

The procedure of Example 1 was repeated, except that the fixation belt 10 shown in FIG. 2 was tested, wherein the PFA tube forming the release layer 14 had a dielectric constant of 5.25 and no optical transmission property.

Measurement of Dielectric Constant

The dielectric constant of each of the PFA tubes produced in Examples 1 and 2 and Comparative Examples 1 to 5 was measured by means of an LCR meter (4284A, product of Hewlett-Packard). The measurement was performed at a frequency of 300 Hz.

Measurement of Optical Transmission Density

The optical transmission density of each of the PFA tubes produced in Examples 1 and 2 and Comparative Examples 1 to 5 was measured by means of a transmission reflection densitometer (Photographic Densitometer 310, product of X-Rite). The measurement was performed for a PFA tube in a non-attached state along the thickness direction.

Measurement of Percent Dielectric Relaxation

The percent dielectric relaxation of each of the PEA tubes produced in Examples 1 and 2 and Comparative Examples 1 to 5 was measured by means of a dielectric relaxation meter. In the specific procedure, a voltage of 4 kV was applied between the surface of the PFA tube and a relevant electrode, to thereby cause arc discharge. Then, the voltage was measured 0.3 seconds after and 10 seconds after the arc discharge by means of a surface electrometer.

Measurement of Surface Roughness

The arithmetic average roughness (Ra) of each of the PFA tubes produced in Examples 1 and 2 and Comparative Examples 1 to 5 was measured in accordance with JIS 94. The measurement was performed at a measurement length of 0.4 mm and a cutoff of 0.08 mm.

Measurement of Surface Resistivity

The surface resistivity of each of the PFA tubes produced in Examples 1 and 2 and Comparative Examples 1 to 5 was measured by means of a resistivity meter (Hiresta UP MCP-HT450, product of Mitsubishi Chemical Analytech Co., Ltd.) and a probe (UR-100 MCP-HTP16, product of Mitsubishi Chemical Analytech Co., Ltd.). The measurement was performed at the surface of a cut PFA tube under voltage application of 100 V for 10 seconds.

Assessment of Releasability

Each of the fixation belts 10 produced in Examples 1 and 2 and Comparative Examples 1 to 5 was set in an image-forming apparatus. A toner image was printed, and occurrence of hot offset was observed, to thereby assess releasability. Occurrence of hot offset was rated with "X" (poor releasability), and absence of hot offset was rated with "O" (good releasability).

Assessment of Electrostatic Offset

Each of the fixation belts 10 produced in Examples 1 and 2 and Comparative Examples 1 to 5 was set in an image-forming apparatus. A toner image was printed, and occurrence of electrostatic offset was assessed. Occurrence of electrostatic offset was rated with "X," and absence of electrostatic offset was rated with "O."

TABLE 1

| | Dielec. const. | Optical transmission density | Thickness [μm] | Dielec. relaxation (%) | Surface roughness Ra [μm] | Surface resistivity [Ω/square] | Releasability | Electrostatic offset | Total evaluation |
|---|---|---|---|---|---|---|---|---|---|
| Comp. Ex. 1 | 2.10 | 0.058 | 30 | 0.8 | 0.01 | $\geq 10^{10}$ | ○ | X | X |
| Example 1 | 2.18 | 3.35 | 30 | 2.0 | 0.04 | $\geq 10^{10}$ | ○ | ○ | ○ |
| Example 2 | 2.27 | 3.8 | 30 | 4.9 | 0.06 | $\geq 10^{10}$ | ○ | ○ | ○ |
| Comp. Ex. 2 | 2.58 | no transmission | 30 | 6.2 | 0.08 | $\geq 10^{10}$ | X | ○ | X |
| Comp. Ex. 3 | 2.87 | no transmission | 30 | 8.2 | 0.08 | $\geq 10^{10}$ | X | ○ | X |
| Comp. Ex. 4 | 3.43 | no transmission | 30 | 25.4 | 0.08 | $\geq 10^{10}$ | X | ○ | X |
| Comp. Ex. 5 | 5.25 | no transmission | 30 | 59.2 | 0.07 | UNDER | X | ○ | X |

As is clear from TABLE 1, since a PFA tube (a slightly conducting tube) having a dielectric constant of 2.15 to 2.5 and an optical transmission density of 1 to 4 was used in Examples 1 and 2, a percent dielectric relaxation of 1.0% to 5.0%, a surface roughness (Ra) of 0.02 μm to 0.06 μm, and a surface resistivity of $10^{10}$ Ω/square or higher were attained. Thus, the PFA tube attained both electrical conductivity and high releasability, and deposition of offset toner on the fixation belt 10 and the recording medium 26 were prevented.

In contrast, as is clear from TABLE 1, since a PFA tube having a dielectric constant smaller than 2.15 and an optical transmission density lower than 1 was used in Comparative Example 1, the percent dielectric relaxation, the surface roughness, and the surface resistivity fell outside the target ranges. In other words, conceivably, electrostatic offset on the recording medium 26 failed to be prevented in Comparative Example 1, since a PFA tube having a percent dielectric relaxation smaller than 1.0% and no slight conductivity was used.

As is also clear from TABLE 1, since a slightly conducting tube having a dielectric constant in excess of 2.5 and no optical transmission property was used in Comparative Examples 2 to 5, the percent dielectric relaxation, the surface roughness, and the surface resistivity fell outside the target ranges. In other words, a PFA tube having an electrical conductivity corresponding to a percent dielectric relaxation higher than 5.0% was used in Comparative Examples 2 to 5. Thus, conceivably, hot offset on the recording medium 26 failed to be prevented in Comparative Examples 2 to 5, since the surface energy of the tube increases, and the toner releasability of the fixation belt 10 was poor.

The fixation member according to the present invention is suited particularly for use in a fixation unit of an image-forming apparatus such as an electrophotographic printer or copying machine.

What is claimed is:

1. A fixation member having a release layer on a surface thereof, wherein the release layer is formed of a fluororesin tube formed through extrusion of a fluororesin including carbon, the fluororesin tube has a percent dielectric relaxation of 1.0% to 5.0%, the fluororesin tube has a dielectric constant of 2.15 to 2.5, the fluororesin tube has a surface resistivity of $10^{10}$ Ω/square or higher, and the percent dielectric relaxation after charging at 4 kV is defined by formula (1) and formula (2):

drop in surface voltage for 10 seconds=initial charge−charge after 10 seconds (1), and percent dielectric relaxation=(drop in surface voltage for 10 seconds/initial charge)×100 (2), and the release layer has a surface with an arithmetic average roughness (Ra) of 0.02 μm to 0.06 μm.

2. The fixation member according to claim 1, wherein the release layer is formed of a fluororesin tube including carbon, the fluororesin tube has an optical transmission density of 1 to 4, and the optical transmission density is a transparency indicator defined by formula (3) and formula (4):

optical transmittance=transmitted light/incident light (3), and optical transmission density=$\log_{10}$(1/optical transmittance) (4).

3. The fixation member according to claim 1, wherein the fixation member is a fixation roller.

* * * * *